US006254435B1

(12) United States Patent
Cheong et al.

(10) Patent No.: US 6,254,435 B1
(45) **Date of Patent: *Jul. 3, 2001**

(54) EDGE CARD CONNECTOR FOR A PRINTED CIRCUIT BOARD

(75) Inventors: Kai Mook Cheong, Naperville; James L. McGrath, Bloomingdale; Richard A. Nelson, Geneva; Augusto P. Panella, Naperville; Javier Resendez, Streamwood; Timothy R. McClelland, Bolingbrook, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/323,317

(22) Filed: Jun. 1, 1999

(51) Int. Cl.[7] ..... H01R 24/00
(52) U.S. Cl. ..... 439/637; 439/60
(58) Field of Search ..... 439/59, 60, 61, 439/62, 63, 64, 65, 101, 108, 636, 637, 607, 608

(56) References Cited

U.S. PATENT DOCUMENTS

| | | | | |
|---|---|---|---|---|
| 3,199,066 | | 8/1965 | Eledge et al. | 339/176 |
| 3,399,372 | * | 8/1968 | Uberbacher | 439/60 |
| 4,891,023 | | 1/1990 | Lopata | 439/637 |
| 5,026,292 | | 6/1991 | Pickles et al. | 439/108 |
| 5,071,371 | | 12/1991 | Harwath et al. | 439/637 |
| 5,162,002 | | 11/1992 | Regnier | 439/637 |
| 5,259,768 | | 11/1993 | Brunker et al. | 439/60 |
| 5,309,630 | * | 5/1994 | Brunker et al. | 29/842 |
| 5,522,737 | | 6/1996 | Brunker et al. | 439/637 |
| 5,813,883 | | 9/1998 | Lin | 439/637 |
| 5,853,303 | | 12/1998 | Brunker et al. | 439/637 |
| 6,015,299 | * | 1/2000 | Walse et al. | 439/60 |
| 6,095,821 | * | 8/2000 | Panella et al. | 439/60 |

* cited by examiner

*Primary Examiner*—Gary F. Paumen
*Assistant Examiner*—Ross Gushi
(74) *Attorney, Agent, or Firm*—Charles S. Cohen

(57) ABSTRACT

An edge card electrical connector is adapted for receiving an edge of a printed circuit board having contact pads on at least one side of the board adjacent the edge. The connector includes an elongated dielectric housing having a board-receiving face with an elongated slot for receiving the edge of the printed circuit board. A plurality of terminal-receiving cavities are spaced longitudinally of the slot along at least one side thereof and separated by transverse walls. A plurality of first and second terminals are received in the cavities. The shapes of the terminals are such as to provide excellent capacitive coupling between the first and second terminals to improve electrical performance and reduce crosstalk of the connector.

31 Claims, 7 Drawing Sheets

EDGE CARD CONNECTOR FOR A PRINTED CIRCUIT BOARD

FIELD OF THE INVENTION

This invention generally relates to the art of electrical connectors and, particularly, to a high performance edge card connector for a printed circuit board.

BACKGROUND OF THE INVENTION

A popular type of electrical connector which is used widely in the electronic industry is called an "edge card" connector. An edge card connector receives a printed circuit board or card having a mating edge and a plurality of contact pads adjacent the edge. Such edge card connectors have an elongate housing defining an elongate receptacle or slot for receiving the mating edge of the printed circuit board. A plurality of terminals are spaced along one or both sides of the slot for engaging the contact pads adjacent the mating edge of the board. In most applications, such edge connectors are mounted on a second printed circuit board. The mating edge board or card commonly is called the "daughter" board, and the board to which the connector is mounted commonly is called the "mother" board, a backplane or a base board.

One of the problems with edge card connectors of the character described above centers around the ever-increasing demands for high speed and miniaturized electronic circuitry. The terminals of such a connector are mounted in a housing fabricated of dielectric material such as plastic or the like. Not only are the terminals becoming ever-increasingly miniaturized, but their density within the housing is becoming greater and greater. The terminals are mounted in rows along the slot of the housing with the terminals being separated by dielectric partitions or walls integral with the housing, and the housing includes side walls for surrounding the terminals. Unfortunately, such high density circuitry can result in increased crosstalk and poor impedance control.

For example, microprocessors operate at ever increasing frequencies and communicate with ancillary devices such as memory, display drivers and the like over wide channels with increasing numbers of parallel connections. The interconnection of such high frequency circuitry may be accomplished with connectors having closely spaced terminals, terminals having relatively small cross sectional areas, or both. The requirement for high frequency operation results in the need for a controlled impedance in order to transmit or pass fast digital pulse rise times with minimal distortion. However, close circuit spacing can result in the aforementioned increased crosstalk due to signal-to-signal coupling. The present invention is directed to solving this myriad of problems and particularly to providing a terminal arrangement wherein the signal terminals are provided with controlled signal-to-ground capacitive coupling and shielding along substantially the entire signal paths of the terminals and therefore resulting in controlled inductance and impedance.

SUMMARY OF THE INVENTION

An object, therefore, of the invention is to provide a new and improved edge card electrical connector for receiving an edge of a printed circuit board having contact pads adjacent the edge.

In the exemplary embodiment of the invention, the edge card connector includes an elongated dielectric housing having a board-receiving face. An elongated slot is disposed in the board-receiving face generally along a longitudinal axis of the housing for receiving the edge of the printed circuit board. A plurality of transversely spaced apart terminal-receiving cavities are provided for receiving respective ones of a plurality of first and second terminals engageable with the contact pads of the printed circuit board. The arrangement of cavities defines at least one row of cavities lengthwise of the housing along the slot. The cavities in the row are separated by transverse walls extending generally perpendicular to the longitudinal axis of the housing. A plurality of first and second terminals are received in the plurality of terminal-receiving cavities.

Each of the first terminals includes a base portion having a retention section mounting the terminal in the housing. A resilient spring arm extends from the base portion and terminates in a contact portion that projects into the slot for engaging one of the contact pads on the printed circuit board. An enlarged head portion may be provided at a distal end of the resilient spring arm and extends from the contact portion away from the slot between an adjacent pair of the transverse walls of the housing. A tail portion extends from the base portion for interconnection to circuitry on a circuit member. A shield portion may project downwardly from the base portion spaced from and in the same direction as the tail portion. A mechanically non-functional impedance-matching section may also project from the base portion.

Each of the second terminals includes a base portion having a retention section mounting the terminal in the housing. The base portion and the retention section of the second terminal may be within the longitudinal profile of the base portion and retention section of the first terminal, i.e., in a direction longitudinally of the housing. A resilient spring arm extends from the base portion and terminates in a contact portion at the slot for engaging one of the contact pads on the printed circuit board. The spring arm of the second terminal is preferably within the longitudinal profile of the spring arm of the first terminal. A finger portion or an enlarged head portion may be provided at a distal end of the narrow resilient spring arm and extends from the contact portion away from the slot between an adjacent pair of the transverse walls of the housing. The finger portion or the enlarged head portion of the second terminal is preferably within the longitudinal profile of the enlarged head portion of the first terminal. A tail portion extends from the base portion for interconnection to circuitry on the circuit member. An enlarged support portion may be provided at the juncture of the tail portion and the base portion outside the housing. The support portion of the second terminal is preferably within the longitudinal profile of the shield portion of the first terminal.

As disclosed herein, the resilient spring arm of the first terminal is wider than the resilient spring arm of the second terminal. Each of the first and second terminals is fabricated of stamped sheet metal material.

Substantially the entire second terminal, except for the contact portion, a small section of the retention section and the tail portion thereof, is within the longitudinal profile of the first terminal. This provides for substantial capacitive coupling between the terminals and, if the first terminal is a ground or reference terminal and the second terminal is a signal terminal, the ground terminal substantially shields the signal terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
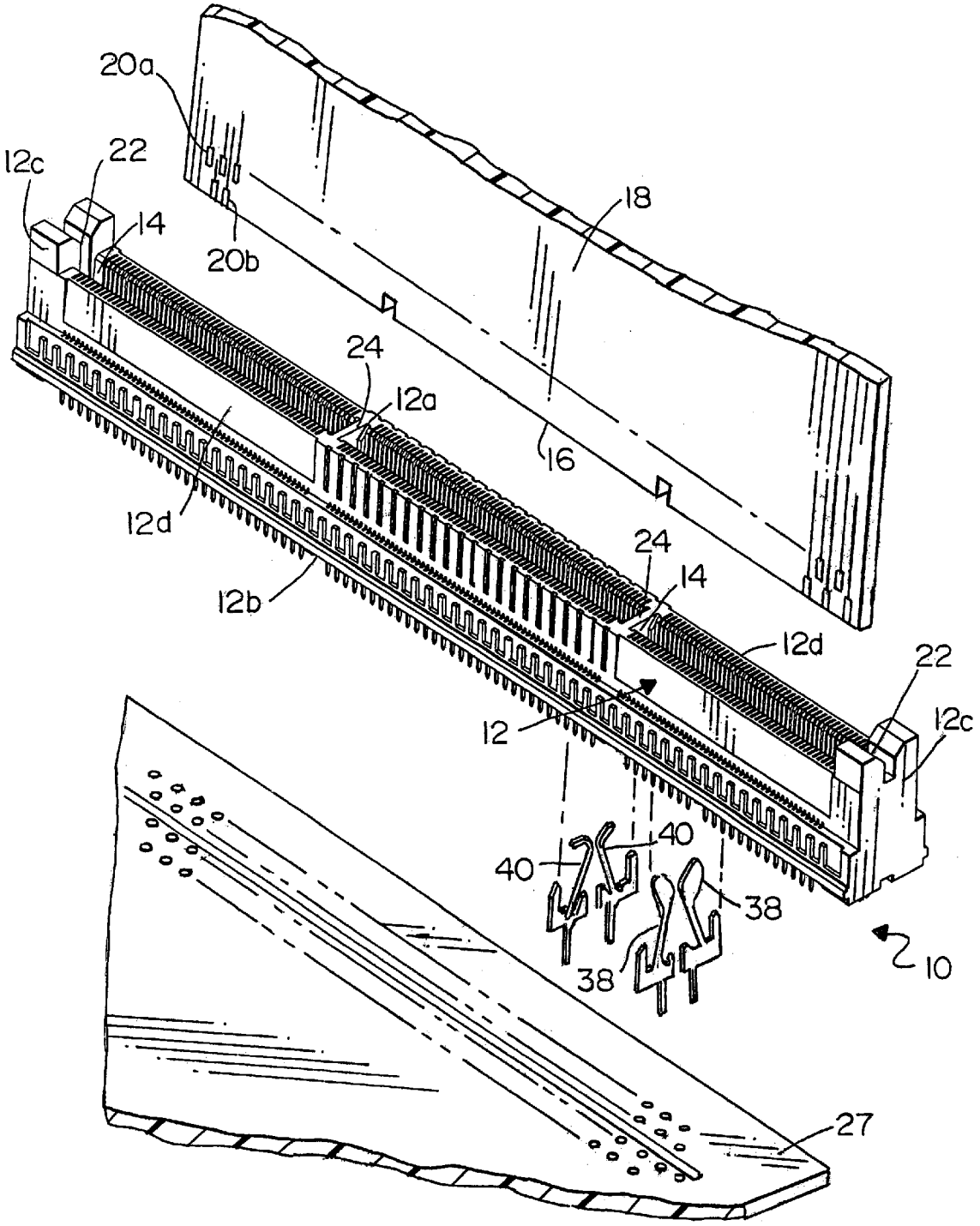
FIG. 1 is a partially exploded perspective view of an electrical connector according to the invention.
Figure 2:
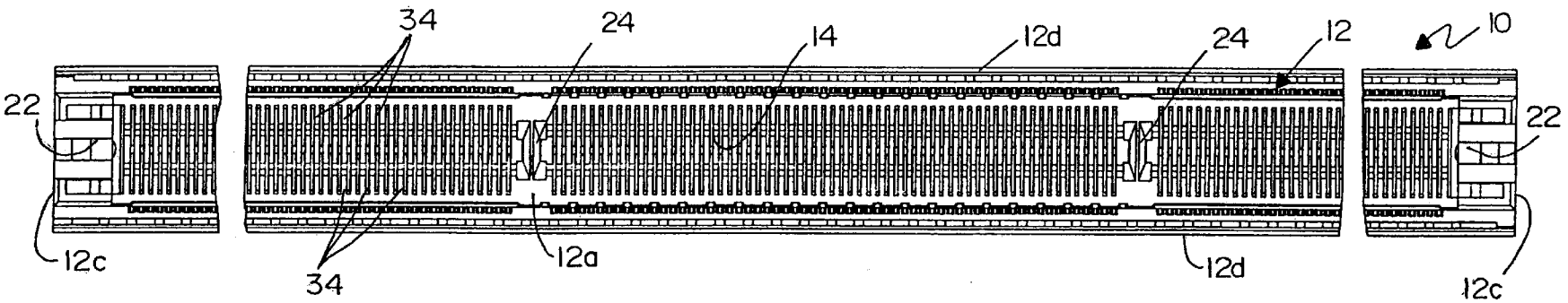
FIG. 2 is a top plan view of the connector.
Figure 3:
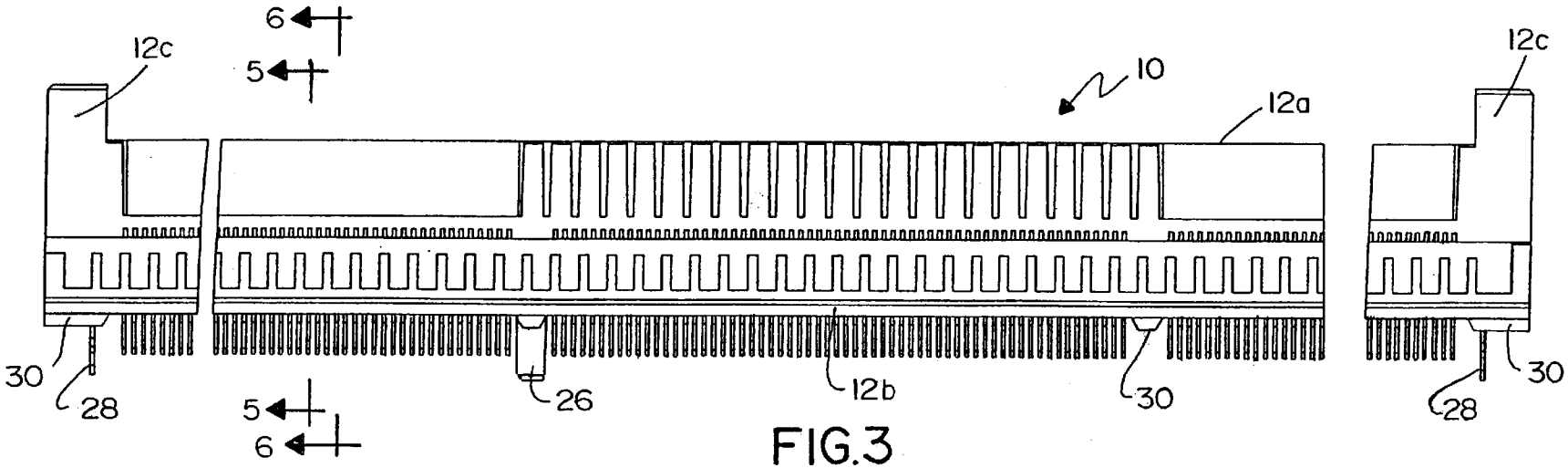
FIG. 3 is a side elevational view of the connector.

Referring to the drawings in greater detail, and first to FIGS. 1–3, the invention is embodied in an elongated electrical connector, generally designated 10, of the edge card type. The connector is typical of this type of electrical connector in that it includes a unitarily molded, one-piece elongated dielectric housing, generally designated 12, defining a board-receiving face 12*a* and a board-mounting face 12*b*. The board-receiving face 12*a* includes an elongated receptacle or card slot 14 for receiving a mating edge 16 (FIG. 4) of a printed circuit board 18. A plurality of terminals (described hereinafter) are spaced along both sides of slot 14 for engaging contact pads 20*a* and 20*b* adjacent mating edge 16 on both sides of printed circuit board 28. Card slot 14 extends, as at 22 (FIG. 1), into a pair of upright supports 12*c* of housing 12 at opposite ends of the slot. A pair of ribs 24 extend between opposite longitudinal side walls 12*d* of the housing. The ribs provide multiple functions such as supporting the side walls, defining the card slot as well as providing polarization for printed circuit board 18.

In most applications, edge card connectors, such as connector 10, are mounted on a second printed circuit board 27, i.e., by board-mounting face 12*b* of connector housing 12. The mating circuit board or edge card 18 commonly is called the "daughter" board, and the circuit board 27 to which the connector is mounted commonly is called the "mother" board. Consequently, connector housing 12 may include one or more mounting posts 26 (FIG. 3) molded integrally therewith and/or one or more metal boardlocks 28. The mounting posts and boardlocks project into appropriate mounting holes and locking holes, respectively, in the motherboard. A plurality of standoffs 30 (FIG. 3) project downwardly from board-mounting face 12*b* of housing 12 a predetermined distance to space the housing from the motherboard upon placement thereon.

Figure 4:
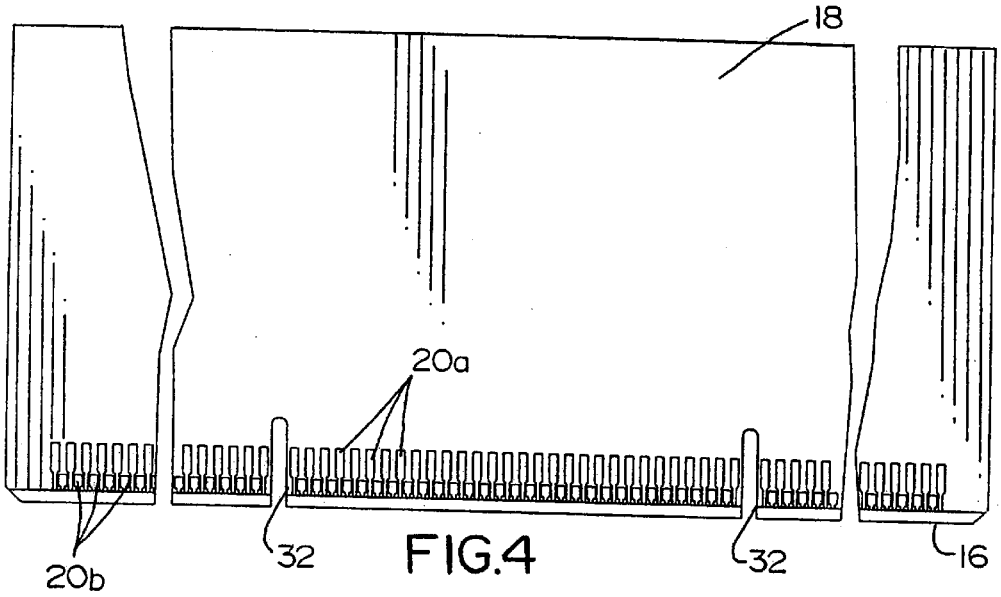
FIG. 4 is a side elevational view of a printed circuit board or edge card for insertion into the connector.

Referring specifically to FIG. 4, it can be seen that daughter board or edge card 18 has a pair of polarizing notches 32 in edge 16 thereof. These polarizing notches receive polarizing ribs 24 (FIG. 1) of housing 12 to ensure the board is properly oriented edgewise within card slot 14 relative to the elongated connector. It also can be seen in FIG. 4 that contact pads 20*a* and 20*b* are in two rows adjacent edge 16 of the edge card, with the row of contact pads 20*b* being closer to edge 16 than the row of contact pads 20*a*. Each of the rows of contact pads is generally parallel to mating edge 16.

Figure 5:
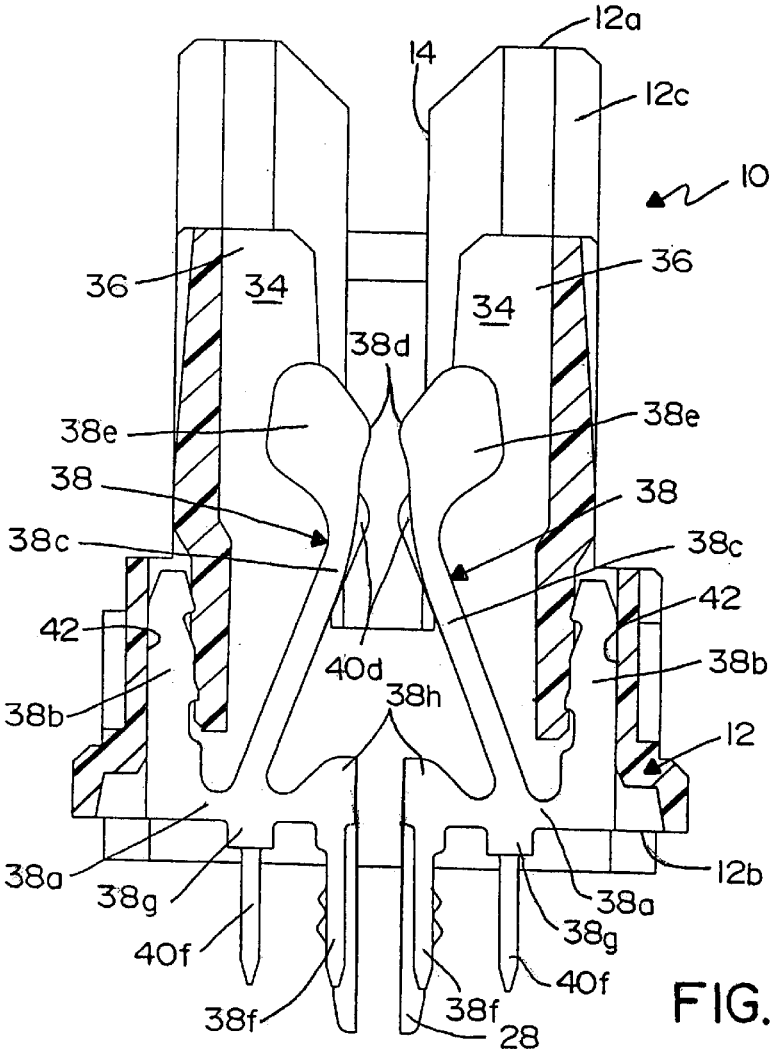
FIG. 5 is a vertical section taken generally along line 5—5 of FIG. 3.
Figure 6:
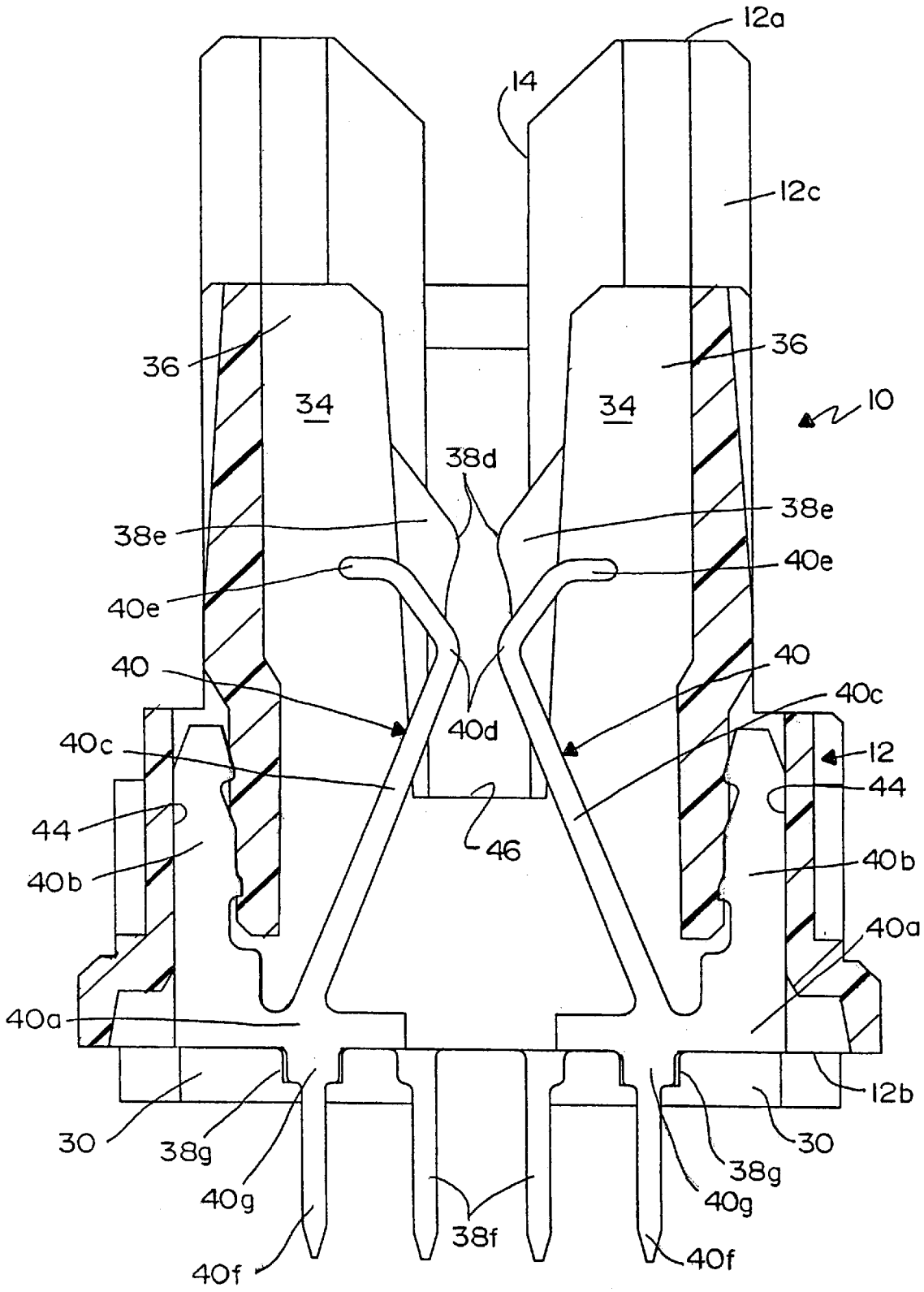
FIG. 6 is a vertical section taken generally along line 6—6 of FIG. 3.

Referring to FIGS. 5 and 6 in conjunction with FIGS. 1 and 2, elongated housing 12 of connector 10 has a plurality of pairs of transversely spaced apart terminal-receiving cavities 34. The pairs of transversely spaced terminal-receiving cavities define two rows of cavities lengthwise of the housing, each on opposite sides of card slot 14. The cavities in each row are separated by transverse walls 36 of the housing. The transverse walls extend generally perpendicular to a longitudinal axis of the housing that extends generally down the center-line of elongated card slot 14. The pairs of transversely spaced cavities receive respective ones of a plurality of pairs of first terminals or contacts, generally designated 38 in FIG. 5, and second terminals or contacts, generally designated 40 in FIG. 6. The pairs of first terminals 38 alternate with the pairs of second terminals 40 longitudinally of housing 12. All of the terminals are stamped or "blanked" from conductive sheet metal material and are generally planar with their planes generally perpendicular to the card slot. In a given application, first terminals 38 may be ground, reference and/or power terminals and second terminals 40 may be signal terminals. In fact, it may also be desirable in some applications to utilize some of the second terminals for power. For convenience, such first terminals 38 are referred to hereafter as ground terminals. In some applications, it may be desirable to produce the terminals by stamping and forming the terminals.

More particularly, referring specifically to FIG. 5, it can be seen that a pair of ground terminals 38 is received in one of the pairs of transversely spaced cavities 34. The two terminals are identical in configuration and structure except that they are oriented on opposite sides of the slot 14 to make contact with the daughter card on opposite sides thereof. Each terminal 38 includes a base portion 38*a* having a retention section 38*b* extending therefrom and secured within a mounting passage 42 for securing the terminal in the housing. A narrow resilient spring arm 38*c* extends upwardly from the base portion and is angled inwardly toward card slot 14 and includes a contact portion 38*d* at the slot for engaging one of the contact pads 20*a* (FIG. 4) of edge card 18. An enlarged head portion 38*e* is formed at a distal end of the narrow resilient spring arm 38*c* and extends from the contact portion 38*d* away from the card slot 14 and into the respective cavity between an adjacent pair of the transverse walls 36. A tail portion 38*f* extends downwardly from the base portion for insertion into an appropriate hole in the motherboard and for electrical connection to circuit traces on the board and/or in the hole. A generally rectangular shield portion or tab 38*g* also extends downwardly from the base portion spaced transversely of tail portion 38*f*. Finally, a mechanically non-functional impedance-matching section 38*h* projects upwardly and inwardly from the base portion at the inside corner thereof. The size of section 38*h* is determined during the design phase of manufacturing the connector to provide a given characteristic impedance value of the circuit within which the particular connector is to be interconnected.

Referring specifically to a pair of signal terminals 40 shown in FIG. 6, the two signal terminals are identical in configuration and structure except that they are in opposing orientations within one of the pairs of transverse spaced cavities 34 within housing 12. Each terminal 40 includes a base portion 40*a* having a retention section 40*b* extending therefrom secured within a mounting passage 44 for securing the terminal in the housing. A narrow resilient spring arm 40*c* extends upwardly from the base portion angularly toward card slot 14 and includes in a contact portion 40*d* at the slot for engaging one of the contact pads 20*b* (FIG. 4) of edge card 18. A finger portion 40*e* is provided at a distal end of narrow resilient spring arm 40*c* and extends from contact portion 40*d* away from the card slot into the respective cavity 34 between an adjacent pair of the transverse walls 36. The finger portions ensure that the resilient spring arms of the terminals are maintained in transverse alignment within cavities 34 and thus spaced from ground terminals 38. A tail portion 40*f* extends downwardly from the base portion for insertion into an appropriate hole in the motherboard and for interconnection to an appropriate circuit trace on the printed circuit board and/or in the hole. A generally rectangular enlarged support portion 40*g* is formed at the juncture of tail portion 40*f* and base portion 40*a* outside housing 12. Support portion 40*g* extends below board-mounting face 12*b* of the housing and provides additional strength for the tail portion.

When edge card 18 (FIG. 4) is inserted into card slot 14 of connector housing 12, edge 16 of the card will successively engage contact portions 38*d* of ground terminals 38 and contact portions 40*d* of signal terminals 40. Narrow resilient spring arms 38*c* of the ground terminals and 40*c* of the signal terminals are shown in their undeflected positions in FIGS. 5 and 6. As the edge card is inserted into card slot 14 toward a bottom 46 thereof, the edge card causes the resilient spring arms to deflect and thus be biased outwardly and effectively apply inward pressure at the contact portions of the terminals on the contact pads of the edge card.

Figure 7:
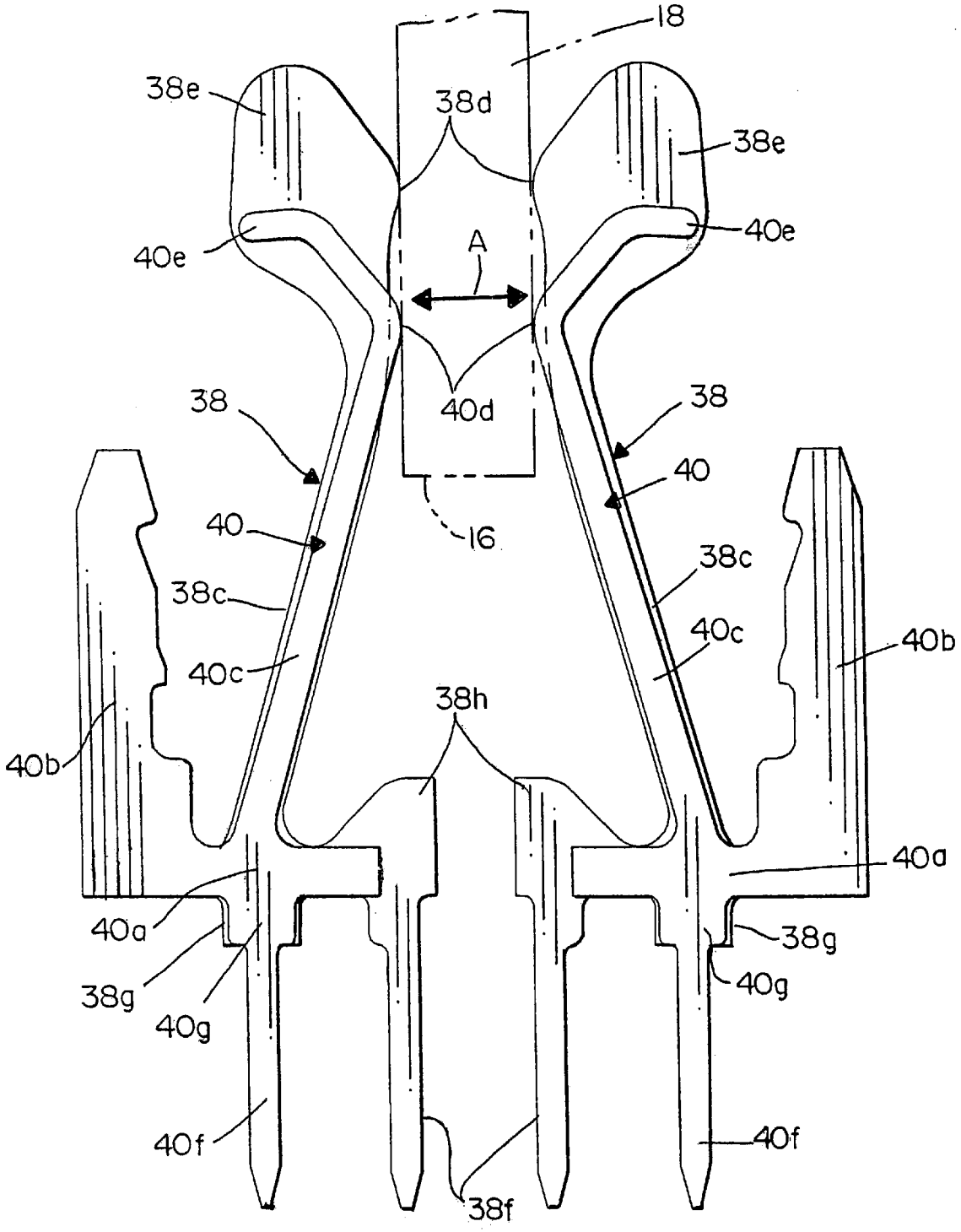
FIG. 7 is a view superimposing a pair of the signal terminals over a pair of the ground terminals, with the connector housing removed for clarity.

FIG. 7 shows a pair of signal terminals 40 superimposed over a pair of ground terminals 38, and with the respective resilient spring arms 40*c* and 38*c* having been deflected outwardly in the direction of double-headed arrow "A" by edge card 18 shown in phantom. The base portions 40*a* and retention sections 40*b* of signal terminals 40 are almost entirely within the longitudinal profile of the base portions 38*a* and retention sections 38*b* of ground terminals 38, i.e., in a direction longitudinally of the connector.

Narrow resilient spring arms 40*c* of the signal terminals are within the longitudinal profiles of spring arms 38*c* of ground terminals 38. The spring arms 40*c* of the signal terminals are generally parallel to and slightly narrower than the springs arms 38*c* of the ground terminals. Finger portions 40*e* of the signal terminals are within the longitudinal profiles of enlarged head portions 38*e* of the ground terminals. Finally, enlarged support portions 40*g* of the signal terminals are within the longitudinal profile of rectangular shield portions 38*g* of the ground terminals.

From the foregoing, it can be seen in FIG. 7 that, except for the very small projecting contact portions 40*d* and tail portions 40*f* (which is within motherboard 27), the entire structural configurations of signal terminals 40 are within the longitudinal profiles of ground terminals 38. In essence, the ground terminals "shadow" or overlie the signal terminals, even including the downwardly projecting enlarged support portions 40*g* of the signal terminals. This provides excellent signal-to-ground capacitive coupling between the signal terminals and the ground terminals, decreases the signal-to-signal coupling and thus significantly reduces the crosstalk of the connector. Another benefit of the aforementioned terminals is excellent impedance control.

Figure 9:
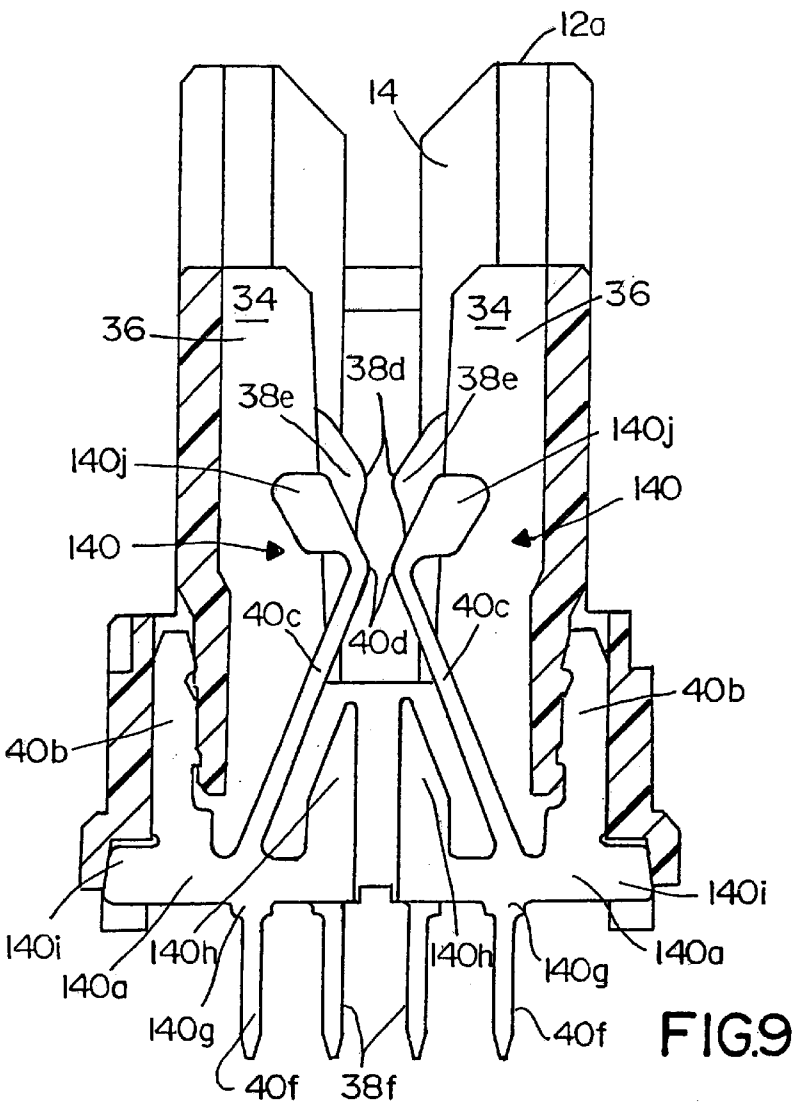
FIG. 9 is a vertical section similar to FIG. 6 but of the second or signal terminals of the alternate embodiment.
Figure 8:
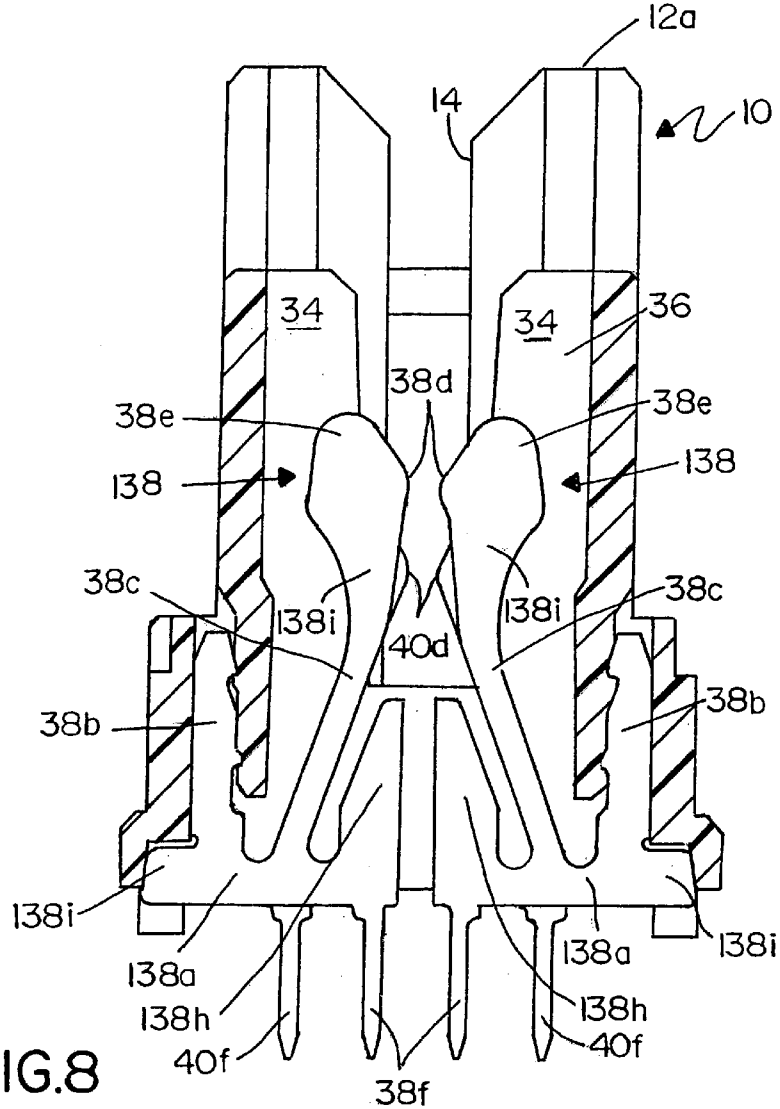
FIG. 8 is a vertical section similar to FIG. 5 but of the first or ground terminals of an alternate embodiment of the invention.
Figure 10:
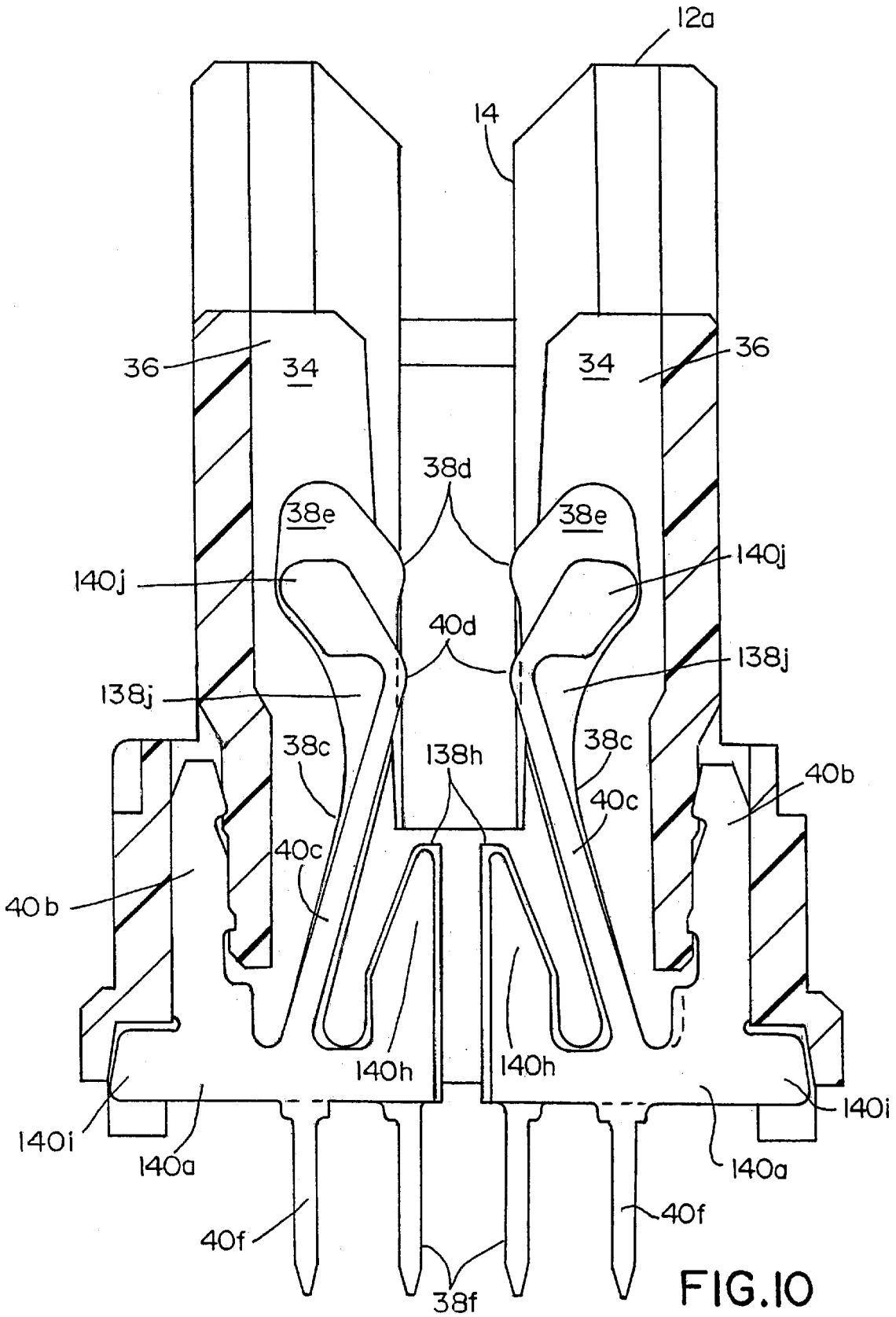
FIG. 10 is a view similar to FIG. 7 but with the terminals of FIGS. 8 and 9 shown in relation to the housing.

Referring now to FIGS. 8–10, a second embodiment of the present invention is disclosed which is different from the first embodiment primarily with respect to certain aspects of the ground and signal terminals of the first embodiment. The parts of the second embodiment that are the same as those of the first embodiment are indicated by the same reference numerals as used in FIGS. 1–7 and descriptions of such identical parts are omitted from the description of this second embodiment.

As best seen by comparing FIG. 8 with FIG. 5, the ground terminals indicated generally at 138 of the second embodiment are generally similar to ground terminals 38. There are, however, a few distinctions. First, the base portion 138*a* is taller or wider vertically. As such, the rectangular shield portion or tab 38*g* of terminal 38 is eliminated. The base 138*a* is also widened horizontally by adding horizontal tab 138*i*. In addition, the mechanically non-functional impedance-matching section 138*h* is substantially enlarged both vertically and horizontally. In fact, the size of section 138*h* has been maximized in view of the space available without interfering with the deflectable resilient spring arm 38*c*, the card slot 14 or the impedance matching section 138*h* of the aligned ground terminal 138 located across the card slot. Finally, the transition 138*j* between the resilient spring arm 38*c* and enlarged head portion 138*e* is enlarged so that the transition between the spring arm and the head portion is more gradual. It can be seen that each of these changes increases the surface area of the ground terminal 138.

The signal terminal indicated generally at 140 of the second embodiment is also enlarged compared to that of the first embodiment. By comparing FIG. 9 with FIG. 6, it can be seen that signal terminal 140 also has an enlarged base portion 140*a*. The base portion is enlarged vertically which reduces the length of enlarged support portion 140*g*. The base portion 140*a* is also widened horizontally by adding horizontal tabs 140*i*. The signal terminal 140 has a mechanically non-functional impedance matching section 140*h* projecting upwardly and inwardly from the base portion 140*a* at an inside corner thereof. As with the impedance matching section 138*h* of the ground terminal 138, the size of impedance matching section 140*h* of signal terminal 140 is maximized in view of the space available and the desire for enhanced shielding and capacitive coupling with the ground terminals as described below. Finally, signal terminal 140 has an enlarged head portion 140*j* formed at a distal end of the narrow resilient spring arm 40*c* and extending from the contact portion 40*d* away from card slot 14 and into the respective cavity between an adjacent pair of transverse walls 36.

FIG. 10 shows a pair of signal terminals 140 of the second embodiment superimposed over a pair of ground terminals 138 of the second embodiment. As with the first embodiment, essentially the entire signal terminal is within the longitudinal profile of the ground terminal. The exception being the edge of contact portions 40*d* and tail portions 40*f*. As such, the terminals 138, 140 of the second embodiment provide the benefits of the terminals 38, 40 of the first embodiment with respect to signal-to-ground capacitive coupling, reducing crosstalk and controlling impedance. In addition, the increased surface areas of both the ground and signal terminals 138, 140 increases the capacitance and thus decreases the impedance of the terminals.

Finally, the terminals 138, 140 of the second embodiment provide significant flexibility in matching a desired impedance of electronic component circuitry with that of the connector. The size of any or all of the impedance matching section 140*h*, the enlarged head portion 140*j* and the horizontal tab 140; have been maximized in order to maximize the capacitance and thus reduce impedance of the connector. As a result, the capacitance between the adjacent ground terminals 138 and signal terminals 140 may be decreased (and thus impedance increased) by decreasing the size of any of these components without affecting the mechanical performance (e.g., insertion force, normal force, terminal retention force) of the connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An edge card electrical connector for receiving an edge of a printed circuit board having contact pads along one side of the board adjacent the edge, comprising:

an elongated dielectric housing including a board-receiving face, an elongated slot disposed in the board-receiving face generally along a longitudinal axis of the housing for receiving said edge of the printed circuit board, and a plurality of terminal-receiving cavities for receiving respective ones of a plurality of first and second terminals, said terminal-receiving cavities being spaced apart generally parallel to the longitudinal axis and defining a row of cavities lengthwise of the housing on one side of the slot, the cavities in the row being separated by transverse walls extending generally perpendicular to the longitudinal axis of the housing; and a plurality of first and second terminals received in respective ones of the plurality of terminal-receiving cavities, the first terminals being differently configured than the second terminals, the first terminals and the second terminals being in a predetermined array within the housing, each of said first terminals including a base portion fixed relative to the housing and having a retention section for securing the terminal in the housing, a resilient, deflectable spring arm extending from the base portion and being deflectable relative to the base portion and having a contact portion adjacent an end of the spring arm and the slot for engaging one of the contact pads on the printed circuit board, the spring arm of each first terminal deflecting along its entire length from a first position to a second position when said contact portion contacts one of the contact pads and a tail portion extending from the base portion for interconnection to circuitry on a circuit member; and each of said second terminals including a base portion fixed relative to the housing and having a retention section for securing the terminal in the housing, a resilient, deflectable spring arm extending from the base portion and being deflectable relative to the base portion and having a contact portion generally adjacent the slot for engaging another of the contact pads on the printed circuit board, the spring arm of each second terminal deflecting along its entire length from a first position to a second position when said contact portion engages one of the contact pads and being narrower than the spring arm of each first terminal and being within the longitudinal profile of the spring arm of each first terminal in a direction longitudinally of the housing upon deflection of the spring arms of the first and second terminals when the circuit board is inserted into said elongated slot, and a tail portion extending from the base portion for interconnection to circuitry on the circuit member.

2. The edge card electrical connector of claim 1 wherein each of said first and second terminals is fabricated of stamped sheet metal material having a predetermined thickness, each said first terminal being substantially planar with said plane being generally perpendicular to said longitudinal axis.

3. The edge card electrical connector of claim 1 wherein the base portion and retention section of the second terminal are substantially within the longitudinal profile of the base portion and retention section of the first terminal in a direction longitudinally of the housing.

4. The edge card electrical connector of claim 1 wherein said first terminal further includes a shield portion projecting downward from the base portion and said second terminal further includes an enlarged support portion at the juncture of the tail portion and the base portion outside the housing, the enlarged support portion of the second terminal being within the longitudinal profile of the shield portion of the first terminal in a direction longitudinally of the housing.

5. The edge card electrical connector of claim 1 wherein the slot extends from the board-receiving face of the housing to a bottom wall and wherein each said first terminal further includes an enlarged head portion at a distal end of the resilient, deflectable spring arm and extending from the contact portion in a direction away from the bottom wall toward the board-receiving face and laterally with respect to the slot between an adjacent pair of said transverse walls and each said second terminal further includes an enlarged head portion at a distal end of the resilient, deflectable spring arm and extending from the contact portion in a direction away from the bottom wall toward the board-receiving face and laterally with respect to the slot between an adjacent pair of said transverse walls, the enlarged head portion of each second terminal being within the longitudinal profile of the enlarged head portion of each first terminal in a direction longitudinally of the housing upon deflection of the spring arms of the first and second terminals when the circuit board is inserted into said elongated slot.

6. The edge card electrical connector of claim 1 wherein said housing includes two rows of said spaced apart terminal-receiving cavities with said first and second terminals located therein, each row being located on an opposite side of said slot, and at least some of said second terminals being aligned with others of said second terminals across said slot.

7. An edge card electrical connector for receiving an edge of a printed circuit board having contact pads along one side of the board adjacent the edge, comprising:

an elongated dielectric housing including a board-receiving face, an elongated slot extending into the housing from the board-receiving face to a bottom wall and generally along a longitudinal axis of the housing for receiving said edge of the printed circuit board, and a plurality spaced apart terminal-receiving cavities for receiving respective ones of a plurality of first and second terminals and defining a row of cavities lengthwise of the housing on one side of the slot, the cavities in the row being separated by transverse walls extending generally perpendicular to the longitudinal axis of the housing; and a plurality of first and second terminals received in respective ones of the terminal-receiving cavities, the first terminals being differently configured than the second terminals, the first terminals and the second terminals being in a predetermined array within the housing, each of said first terminals including a base portion having a retention section for securing the terminal in the housing, a resilient spring arm extending from the base portion and a contact portion generally adjacent an end of the spring arm and the slot for engaging one of the contact pads on the printed circuit board, an enlarged head portion at a distal end of the resilient spring arm and extending from the contact portion in a direction away from the bottom wall of the slot toward the board-receiving face and laterally with respect to the slot between an adjacent pair of said transverse walls, and a tail portion extending from the base portion for interconnection to circuitry on a circuit member; and each of said second terminals including a base portion having a retention section for securing the terminal in the housing, a resilient spring arm extending from the base portion and having a contact portion generally adjacent an end of the spring arm and the slot for engaging another of the contact pads on the printed circuit board, an enlarged head portion at a distal end of the resilient spring arm of the second terminal and extending from the contact portion in a direction away from the bottom wall of the slot toward the board-receiving face and laterally with respect to the slot between an adjacent pair of said transverse walls, the enlarged head portion of each second terminal being within the longitudinal profile of the enlarged head portion of each first terminal in a direction longitudinally of the housing upon deflection of the spring arms of the first and second terminals when the circuit board is inserted into said elongated slot, and a tail portion extending from the base portion for interconnection to circuitry on the circuit member.

8. The edge card electrical connector of claim 7 wherein the spring arm of each second terminal is within the longitudinal profile of the spring arm of each first terminal in a direction longitudinally of the housing upon deflection of the spring arms of the first and second terminals when the circuit board is inserted into said elongated slot.

9. The edge card electrical connector of claim 7 wherein each of said first and second terminals is fabricated of stamped sheet metal material having a predetermined thickness, each said first terminal being substantially planar with said plane being generally perpendicular to said longitudinal axis.

10. The edge card electrical connector of claim 7 wherein the base portion and retention section of the second terminal are substantially within the longitudinal profile of the base portion and retention section of the first terminal in a direction longitudinally of the housing.

11. The edge card electrical connector of claim 7 wherein said first terminal further includes a shield portion projecting downward from the base portion and said second terminal further includes an enlarged support portion at the juncture of the tail portion and the base portion outside the housing, the enlarged support portion of the second terminal being within the longitudinal profile of the shield portion of the first terminal in a direction longitudinally of the housing.

12. The edge card electrical connector of claim 7 wherein said housing includes two rows of said spaced apart terminal-receiving cavities with said first and second terminals located therein, each row being located on an opposite side of said slot, and at least some of said second terminals being aligned with others of said second terminals across said slot.

13. An edge card electrical connector for receiving an edge of a printed circuit board having contact pads along one side of the board adjacent the edge, comprising:

an elongated dielectric housing including a board-receiving face, an elongated slot disposed in the board-receiving face generally along a longitudinal axis of the housing for receiving said edge of the printed circuit board, and a plurality of spaced apart terminal-receiving cavities for receiving respective ones of a plurality of first and second terminals and defining a row of cavities lengthwise of the housing on one side of the slot, and the cavities in the row being separated by transverse walls extending generally perpendicular to the longitudinal axis of the housing; and a plurality of pairs of first and second terminals received in the plurality of pairs of terminal-receiving cavities, the first terminals being differently configured than the second terminals, the pairs of first terminals and the pairs of second terminals being in a predetermined array within the housing, each of said first terminals including a base portion having a retention section for securing the terminal in the housing, a resilient spring arm extending from the base portion and a contact portion generally adjacent an end of the spring arm and the slot for engaging one of the contact pads on the printed circuit board, a tail portion extending from the base portion for interconnection to circuitry on a circuit member, and a mechanically non-functional impedance-matching section projecting in a cantilevered manner from the base portion spaced apart from the resilient spring arm; and each of said second terminals including a base portion having a retention section for securing the terminal in the housing, a resilient spring arm extending from the base portion and having a contact portion generally adjacent an end of the spring arm and the slot for engaging another of the contact pads on the printed circuit board, a tail portion extending from the base portion for interconnection to circuitry on the circuit member, and a mechanically non-functional impedance-matching section projecting in a cantilevered manner from the base portion of the second terminal spaced apart from the resilient spring arm, the mechanically non-functional impedance-matching section of the second terminal being within the longitudinal profile of the mechanically non-functional impedance-matching section of the first terminal in a direction longitudinally of the housing.

14. The edge card electrical connector of claim 13 wherein the spring arm of each second terminal is within the longitudinal profile of the spring arm of each first terminal in a direction longitudinally of the housing upon deflection of the spring arms of the first and second terminals when the circuit board is inserted into said elongated slot.

15. The edge card electrical connector of claim 13 wherein the base portion and retention section of the second terminal are substantially within the longitudinal profile of the base portion and retention section of the first terminal in a direction longitudinally of the housing.

16. The edge card electrical connector of claim 13 wherein each of said first and second terminals is fabricated of stamped sheet metal material having a predetermined thickness, each said first terminal being substantially planar with said plane being generally perpendicular to said longitudinal axis.

17. The edge card electrical connector of claim 13 wherein said housing includes two rows of said spaced apart terminal-receiving cavities with said first and second terminals located therein, each row being located on an opposite side of said slot, and at least some of said second terminals being aligned with others of said second terminals across said slot.

18. A pair of terminals for mounting in closely spaced face-to-face relationship with a plurality of similar terminal pairs in a housing of a circuit card edge connector for mounting onto a circuit board, said pair of terminals comprising:

a first terminal having a planar body, a terminal retention section for retaining said terminal within the housing, a board contact section extending from said body for interconnection to circuitry on the circuit board and a resilient, deflectable spring arm extending from the body and a contact portion adjacent an end of the spring arm for engaging a contact pad on a printed circuit card, said resilient, deflectable spring arm deflecting along its entire length relative to the body and the spring arm and the contact portion being movable between a first position prior to insertion of said printed circuit card into a slot in the housing and a second deflected position in which the printed circuit card is located in the slot in the housing; and a second terminal aligned with and adjacent said first terminal, said second terminal having a body, a terminal retention section for retaining said terminal within the housing, a board contact section extending from said body for interconnection to circuitry on the circuit board, a resilient, deflectable spring arm extending from the body and a contact portion adjacent an end of the spring arm for engaging another contact pad on said printed circuit card, said resilient, deflectable spring arm deflecting along its entire length relative to the body and the spring arm and the contact portion being movable between a first position prior to insertion of said printed circuit card into a slot in the housing and a second deflected position in which the printed circuit card is located in the slot in the housing, the spring arm of the second terminal being narrower than the spring arm of the first terminal and being within the longitudinal profile of the spring arm of the first terminal in a direction perpendicular to the plane of said body when said spring arms and contact portions of said first and second terminals are in their second deflected positions.

19. The pair of terminals of claim 18 wherein each of said first and second terminals are fabricated of stamped sheet metal material having a predetermined thickness.

20. The pair of terminals of claim 18 wherein the body and retention section of the second terminal are substantially within the longitudinal profile of the body and retention section of the first terminal in a direction perpendicular to the plane of said body.

21. The pair of terminals of claim 18 wherein said first terminal further includes a shield portion projecting downward from the body and said second terminal further includes an enlarged support portion at the juncture of the tail portion and the body, the enlarged support portion of the second terminal being within the longitudinal profile of the shield portion of the first terminal in a direction perpendicular to the plane of said body.

22. The pair of terminals of claim 18 wherein said first terminal further includes an enlarged head portion at a distal end of the resilient, deflectable spring arm and said second terminal further includes an enlarged head portion at a distal end of the resilient, deflectable spring arm, the enlarged head portion of said second terminal being within the longitudinal profile of the enlarged head portion of said first terminal in a direction perpendicular to the plane of said body when said terminals are in their second deflected positions.

23. A pair of terminals for mounting in closely spaced face-to-face relationship with a plurality of similar terminal pairs in a housing of a circuit card edge connector for mounting onto a circuit board, said pair of terminals comprising:

a first terminal having a body, a terminal retention section for retaining said terminal within the housing, a board contact section extending from said body for interconnection to circuitry on the circuit board, a resilient spring arm extending from the body and a contact portion adjacent an end of the spring arm for engaging a contact pad on a printed circuit card and a mechanically non-functional impedance-matching section projecting in a cantilevered manner from the body of the first terminal spaced apart from the resilient spring arm, said resilient spring arm and contact portion being movable between a first position prior to insertion of said printed circuit card into a slot in the housing and a second deflected position in which the printed circuit card is located in the slot in the housing; and a second terminal aligned with and adjacent said first terminal, said second terminal having a planar body, a terminal retention section for retaining said terminal within the housing, a board contact section extending from said body for interconnection to circuitry on the circuit board and a resilient spring arm extending from the body and a contact portion adjacent an end of the spring arm for engaging another contact pad on said printed circuit card, said resilient spring arm and contact portion being movable between a first position prior to insertion of said printed circuit card into the slot in the housing and a second deflected position in which the printed circuit card is located in the slot in the housing, a mechanically non-functional impedance-matching section projecting in a cantilevered manner from the body of the second terminal spaced apart from the resilient spring arm, the mechanically non-functional impedance-matching section of the second terminal being within the longitudinal profile of the mechanically non-functional impedance-matching section of the first terminal in a direction perpendicular to the plane of said body.

24. The pair of terminals of claim 23 wherein each of said first and second terminals are fabricated of stamped sheet metal material having a predetermined thickness.

25. The pair of terminals of claim 23 wherein the body portion and retention section of the second terminal are substantially within the longitudinal profile of the body portion and retention section of the first terminal in a direction perpendicular to the plane of said body.

26. The pair of terminals of claim 23 wherein said first terminal further includes a shield portion projecting downward from the body and said second terminal further includes an enlarged support portion at the juncture of the tail portion and the body, the enlarged support portion of the second terminal being within the longitudinal profile of the shield portion of the first terminal in a direction perpendicular to the plane of said body.

27. The pair of terminals of claim 23 wherein said first terminal further includes an enlarged head portion at a distal end of the resilient spring arm and said second terminal further includes an enlarged head portion at a distal end of the resilient spring arm, the enlarged head portion of said second terminal being within the longitudinal profile of the enlarged head portion of said first terminal in a direction perpendicular to the plane of said body when said terminals are in their second deflected positions.

28. A pair of terminals for mounting in closely spaced face-to-face relationship with a plurality of similar terminal pairs in a housing of a circuit card edge connector for mounting onto a circuit board, said pair of terminals comprising:

a first terminal having a body, a terminal retention section for retaining said terminal within the housing, a board contact section extending from said body for interconnection to circuitry on the circuit board, a resilient spring arm extending from the body and a contact portion adjacent an end of the spring arm for engaging a contact pad on a printed circuit card and an enlarged head portion at a distal end of the resilient spring arm and extending from the contact portion, said resilient spring arm deflecting along its entire length so that the spring arm and the contact portion are movable between a first position prior to insertion of said printed circuit card into a slot in the housing and a second deflected position in which the printed circuit card is located in the slot in the housing; and a second terminal aligned with and adjacent said first terminal, said second terminal having a planar body, a terminal retention section for retaining said terminal within the housing, a board contact section extending from said body for interconnection to circuitry on the circuit board and a resilient spring arm extending from the body and a contact portion adjacent an end of the spring arm for engaging another contact pad on said printed circuit card, said resilient spring arm deflecting along its entire length so that the spring arm and the contact portion are movable between a first position prior to insertion of said printed circuit card into a slot in the housing and a second deflected position in which the printed circuit card is located in the slot in the housing, an enlarged head portion at a distal end of the resilient spring arm and extending from the contact portion, the enlarged head portion of the second terminal being within the longitudinal profile of the enlarged head portion of the first terminal in a direction perpendicular to the plane of said body when said spring arms and contact portions of said first and second terminals are in their second deflected positions.

29. The pair of terminals of claim 28 wherein each of said first and second terminals are fabricated of stamped sheet metal material having a predetermined thickness.

30. The pair of terminals of claim 28 wherein the body portion and retention section of the second terminal are substantially within the longitudinal profile of the body portion and retention section of the first terminal in a direction perpendicular to the plane of said body.

31. The pair of terminals of claim 28 wherein said first terminal further includes a shield portion projecting downward from the body and said second terminal further includes an enlarged support portion at the juncture of the tail portion and the body, the enlarged support portion of the second terminal being within the longitudinal profile of the shield portion of the first terminal in a direction perpendicular to the plane of said body.

* * * * *